US010388254B2

(12) United States Patent
Lee et al.

(10) Patent No.: US 10,388,254 B2
(45) Date of Patent: Aug. 20, 2019

(54) DISPLAY DEVICE AND METHOD OF COMPENSATING LUMINANCE OF THE SAME

(71) Applicant: SAMSUNG DISPLAY CO., LTD., Yongin-si, Gyeonggi-do (KR)

(72) Inventors: Eunho Lee, Suwon-si (KR); Hyundae Lee, Yongin-si (KR); Hyunseuk Yoo, Seoul (KR); Hyungjin Kim, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 72 days.

(21) Appl. No.: 15/820,684

(22) Filed: Nov. 22, 2017

(65) Prior Publication Data

US 2018/0144719 A1 May 24, 2018

(30) Foreign Application Priority Data

Nov. 23, 2016 (KR) ..... 10-2016-0156615

(51) Int. Cl.

| | |
|---|---|
| ***G09G 3/00*** | (2006.01) |
| ***G09G 5/10*** | (2006.01) |
| ***G09G 5/02*** | (2006.01) |

(52) U.S. Cl.

CPC ..... *G09G 5/10* (2013.01); *G09G 5/02* (2013.01); *G09G 2300/0452* (2013.01); *G09G 2320/0233* (2013.01); *G09G 2320/0626* (2013.01)

(58) Field of Classification Search

CPC ..... G09G 3/3644; G09G 2310/04; G09G 2320/00–106; G09G 3/18; G09G 3/2022–204

See application file for complete search history.

(56) References Cited

U.S. PATENT DOCUMENTS 8,085,278 B2 12/2011 Hwang et al.
8,482,509 B2 7/2013 Choe et al.
(Continued)

FOREIGN PATENT DOCUMENTS

KR 10-1319341 10/2013
KR 10-2015-0030013 3/2015
(Continued)

*Primary Examiner* — Sanghyuk Park
(74) *Attorney, Agent, or Firm* — F. Chau & Associates, LLC

(57) ABSTRACT

A display device and a method of compensating a luminance of the display device enhance display quality and reducing storage capacity of a memory, the display device including: a display panel including a plurality of pixels arranged in a matrix form; a storage unit storing a gray level compensation value of a reference pixel defined by at least one pixel; a compensation circuit receiving a gray level datum and generating a compensated gray level datum by applying the gray level compensation value; and a data driving circuit receiving the compensated gray level datum to generate a data voltage and outputting the data voltage to the display panel. The display panel includes a first compensation area and a second compensation area. The reference pixel in the first compensation area is defined by one pixel and the reference pixel in the second compensation area is defined by m×n pixels, m and n being natural numbers greater than 1.

20 Claims, 9 Drawing Sheets

(56) References Cited

U.S. PATENT DOCUMENTS

| | | | | |
|---|---|---|---|---|
| 9,357,209 | B2 | 5/2016 | Kim et al. | |
| 2006/0007239 | A1* | 1/2006 | Harrison | G09G 5/02 345/590 |
| 2006/0061593 | A1* | 3/2006 | Miura | G09G 3/22 345/612 |
| 2008/0036797 | A1* | 2/2008 | Whang | G09G 3/006 345/698 |
| 2008/0050031 | A1* | 2/2008 | Itoh | G06T 5/50 382/260 |
| 2008/0252666 | A1* | 10/2008 | Chen | G09G 3/2044 345/690 |
| 2010/0123742 | A1* | 5/2010 | Jang | G09G 3/342 345/690 |
| 2010/0214209 | A1* | 8/2010 | Seo | G09G 3/342 345/102 |
| 2014/0313243 | A1* | 10/2014 | Gupta | H04N 5/57 345/694 |
| 2015/0070403 | A1 | 3/2015 | Kim et al. | |
| 2015/0213771 | A1* | 7/2015 | Ohnishi | G01J 3/46 345/88 |
| 2015/0348457 | A1* | 12/2015 | Ito | G09G 3/3677 345/690 |
| 2016/0155373 | A1 | 6/2016 | Jang et al. | |
| 2017/0041580 | A1* | 2/2017 | Ohira | G09G 5/00 |

FOREIGN PATENT DOCUMENTS

| | | |
|---|---|---|
| KR | 10-2016-0004136 | 1/2016 |
| KR | 10-1605157 | 3/2016 |
| KR | 10-2016-0064342 | 6/2016 |

* cited by examiner

DISPLAY DEVICE AND METHOD OF COMPENSATING LUMINANCE OF THE SAME

CROSS-REFERENCE TO RELATED APPLICATION

This application claims priority under 35 U.S.C. § 119 from Korean Patent Application No. 10-2016-0156615, filed on Nov. 23, 2016, in the Korean Intellectual Property Office (KIPO), the disclosure of which is incorporated by reference herein.

1. TECHNICAL FIELD

Embodiments of the present inventive concept relate to a display device and a method of compensating luminance of the display device.

2. DISCUSSION OF RELATED ART

Display devices may be classified into various types, such as liquid crystal display ("LCD") devices, organic light emitting diode ("OLED") display devices, plasma display panel ("PDP") devices, electrophoretic display devices and the like based on a light emitting scheme thereof.

After completing manufacturing of a display panel for a display device, the display device undergoes an inspection process for detecting unevenness of the display panel such as mura defects or the like. If the display unevenness is detected during the inspection process, the display panel may undergo a luminance compensation process to address the display unevenness.

The luminance compensation process may include a manual mode in which display unevenness is detected and compensated by an operator, and an automatic mode in which detection and compensation of display unevenness are performed using a camera or the like. Performance of the luminance compensation process via the manual method is disadvantageous in that the accuracy is low and the compensation time is long. In addition, performance of the luminance compensation process through the automatic method compensates for luminance deviations by detecting only a large-sized display unevenness, for example, in units of a block, appearing in a specific area of the display device. Accordingly, the performance of the luminance compensation process via the automatic method has difficulty in compensating for display unevenness such as fine line aura, sharp mum, and the like.

Another way to compensate for fine display unevenness includes a luminance compensation process that may be performed for each unit pixel of the display device. However, when storing all the compensation data for each unit pixel in a memory, the storage capacity of the memory may need to be larger.

It is to be understood that this background of the technology section is intended to provide useful background for understanding the technology and as such disclosed herein, the technology background section may include ideas, concepts or recognitions that were not part of what was known or appreciated by those skilled in the pertinent art prior to a corresponding effective filing date of subject matter disclosed herein.

SUMMARY

Embodiments of the present inventive concept may be directed to a display device capable of enhancing display quality and reducing storage capacity of a memory, and a method of compensating a luminance of the display device.

According to an embodiment of the inventive concept, a display device may include: a display panel including a first compensation area and a second compensation area and a plurality of pixels arranged in a matrix form; a storage unit storing a gray level compensation value of a reference pixel defined by at least one pixel; a compensation circuit receiving a gray level datum and generating a compensated gray level datum by applying the gray level compensation value; and a data driving circuit receiving the compensated gray level datum to generate a data voltage and outputting the data voltage to the display panel. The reference pixel in the first compensation area is defined by one pixel and the reference pixel in the second compensation area is defined by m×n pixels m and n being natural numbers greater than 1.

The gray level compensation value of the reference pixel in the first compensation area may be a gray level compensation value of said one pixel and the gray level compensation value of the reference pixel in the second compensation area may be a gray level compensation value of a predetermined pixel of said m×n pixels.

The storage unit may store a gray level compensation value for the reference pixel corresponding to each of a plurality of reference gray levels.

In the display device, with regard to the m×n pixels that define the second compensation area, m may be a number equal to n.

The display device may further include a third compensation area between the first compensation area and the second compensation area.

A reference pixel in the third compensation area may be defined by i×j pixels, i and j being natural numbers greater than 1.

A surface of the display panel may include a plurality of stamp patterns that form a wire grid polarization pattern, and the first compensation area includes a boundary between at least two of the plurality of stamp patterns that form the wire grid polarization pattern.

The display device may be arranged in a lattice form, and the second compensation area is defined by the lattice arrangement of the first compensation area.

The first compensation area may include a boundary between at least two stamp patterns that are aligned to form a wire grid polarization pattern on a surface of the display panel, wherein the boundary has an increased probability of an occurrence of fine line mura based on an alignment error range of the at least two stamp patterns.

Each of i and j pixels that define the third compensation area may be a number less than the m and n pixels that may define the second compensation area.

The display device may further include a light assembly including at least one light source providing a light to the display panel.

According to an embodiment of the inventive concept, a method of compensating a luminance includes: acquiring a reference gray level image displayed on a display device, and a first compensation area and a second compensation area including a plurality of pixels arranged in a matrix form; generating a reference unit image by reconstructing the reference gray level image with a reference pixel; calculating a gray level compensation value of the reference pixel included in the reference unit image; and generating compensated gray level data by applying the gray level compensation value of the reference pixel to gray level data corresponding to the plurality of pixels. The display device includes a first compensation area and a second compensation area. The reference pixel of the first compensation area is defined by one pixel and the reference pixel of the second compensation area is defined by m×n pixels, m and n being natural numbers greater than 1.

Calculating of the gray level compensation value of the reference pixel may include: determining a luminance representative value of the reference pixel included in the reference unit image; generating a gamma curve of the reference pixel; calculating a luminance compensation value of the reference pixel by using the luminance representative value of the reference pixel; and calculating the gray level compensation value of the reference pixel corresponding to the luminance compensation value by using the gamma curve of the reference pixel.

Determining of the luminance representative value of the reference pixel may include determining a luminance value of said one pixel as the luminance representative value of the reference pixel in the first compensation area.

Determining of the luminance representative value of the reference pixel may include determining an average luminance value, a maximum luminance value or a minimum luminance value of said m×n pixels constituting the reference pixel or a luminance value of a predetermined pixel among said m×n pixels as the luminance representative value of the reference pixel in the second compensation area.

According to an embodiment of the inventive concept, calculating of the luminance compensation value of the reference pixel may include calculating a target luminance value of the reference pixel using a two-dimensional fitting algorithm based on the luminance representative value of the reference pixel; and determining a difference value between the luminance representative value of the reference pixel and the target luminance value of the reference pixel as the luminance compensation value of the reference pixel.

The method may further include storing, in a storage unit, the gray level compensation value of the reference pixel included in the reference unit image.

In the method, in the m×n pixels, m is a number equal to n.

A display device that provides luminance compensation, including: a display panel including a first compensation area and a second compensation area, in which the first compensation area is predefined to a first portion of a surface of the display panel in which an occurrence of fine line mura has a higher probability to occur than on another portion of the display panel designated as a second compensation area, and a reference pixel in the first compensation area is defined by one pixel and a reference pixel in the second compensation area is defined by m×n pixels, m and n being natural numbers greater than 1; wherein the reference pixel of the first compensation area is defined by one pixel and the reference pixel of the second compensation area is defined by m×n pixels being natural numbers.

The foregoing is illustrative only and is not intended to be in any way limiting. In addition to the illustrative aspects, embodiments and features described above, further aspects, embodiments and features will become apparent by reference to the drawings and the following detailed description.

BRIEF DESCRIPTION OF THE DRAWINGS

A more complete appreciation of the present inventive concept will become more apparent to a person of ordinary skill in the art by describing in detail embodiments thereof with reference to the accompanying drawings, wherein.

DETAILED DESCRIPTION

Figure 1:
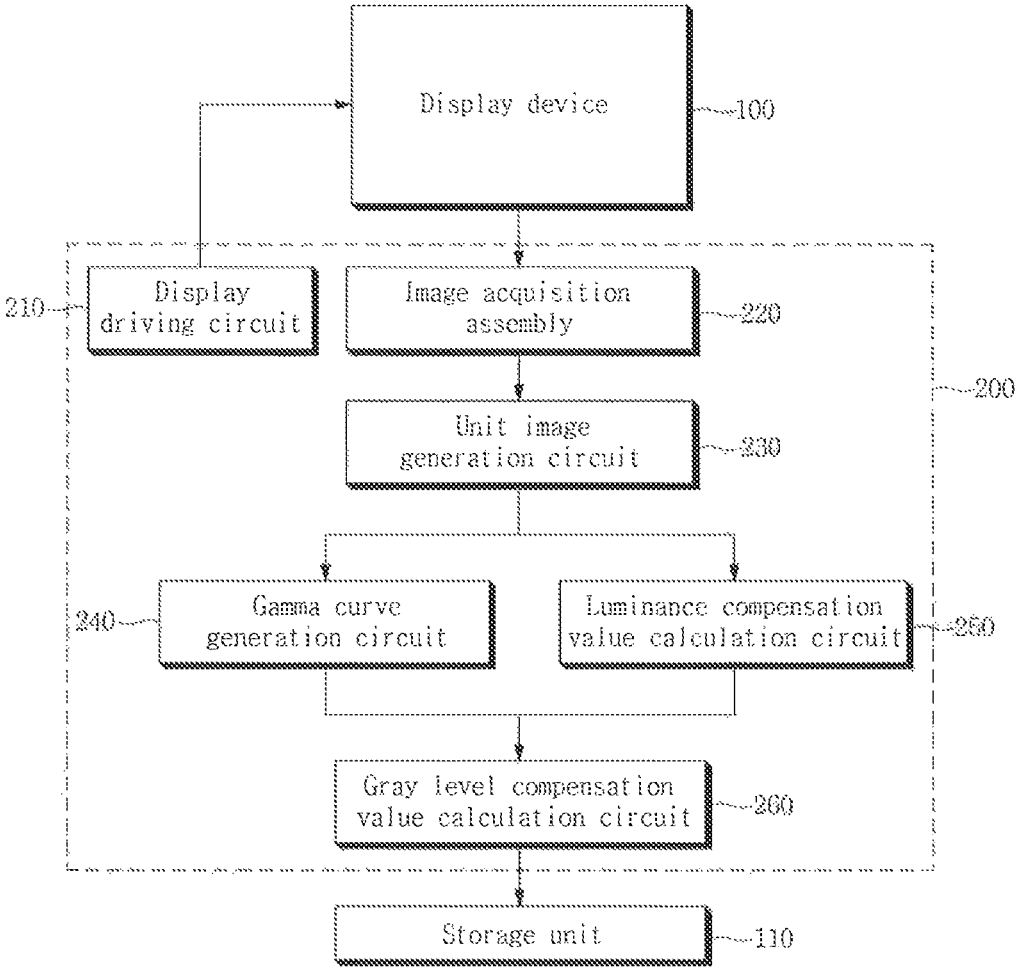
FIG. 1 is a block diagram illustrating a luminance compensation device of a display device according to an embodiment of the inventive concept.

Exemplary embodiments will now be described more fully hereinafter with reference to the accompanying drawings. Although the inventive concept may be modified in various manners and may have one or more embodiments, the illustrations in the accompanying drawings will be the embodiments mainly described in the specification. However, the scope of the inventive concept is not limited to the embodiments and should be construed as including all the changes, equivalents and substitutions included in the spirit and scope of the inventive concept.

In the drawings, the thicknesses of a plurality of layers and areas are illustrated in an enlarged manner for clarity and ease of description thereof. When a layer, area, or plate is constructed so as to be "on" another layer, area, or plate, such a construction may be directly on the other layer, area, or plate, or there may be intervening layers, areas, or plates present therebetween. Conversely, when a layer, area, or plate is referred to as being "directly on" another layer, area, or plate, intervening layers, areas, or plates may be absent there between. Further when a layer, area, or plate is referred to as being "below" another layer, area, or plate, it may be directly below the other layer, area, or plate, or intervening layers, areas, or plates may be present therebetween. Conversely, when a layer, area, or plate is referred to as being "directly below" another layer, area, or plate, intervening layers, areas, or plates may be absent there between.

The spatially relative terms such as "below," "beneath," "lower," "above," "upper" and the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device positioned "below" or "beneath" another device may be placed "above" another device. Accordingly, the illustrative term "below" may include both the lower and upper positions. The device may also be oriented in the other direction and thus the spatially relative terms may be interpreted differently depending on the orientations.

Throughout the specification, when an element is referred to as being "connected" to another element, the element is "directly connected" to the other element, or "electrically connected" to the other element with one or more intervening elements interposed there between. It will be further understood that the terms "comprises," "including," "includes" and/or "including," when used in this disclosure, specify the presence of stated features, integers, steps, operations, elements and/or components, but do not preclude the presence or addition of one or more other features, integers, steps, operations, elements, components and/or groups thereof.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" may be termed likewise without departing from the teachings herein.

"About" or "approximately" as used herein is inclusive of the stated value and is defined as being within an acceptable range of deviation for the particular value as determined by one of ordinary skill in the art, considering the measurement in question and the error associated with measurement of the particular quantity (e.g., the limitations of the measurement system). For example, "about" may be defined as being within one or more standard deviations, or within ±30%, 20%, 10%, 5% of the stated value.

Unless otherwise defined, all terms used herein (including technical and scientific terms) have the same meaning as commonly understood by those skilled in the art to which this inventive concept pertains. It will be further understood that terms, such as those defined in commonly used dictionaries, should be interpreted as having a meaning that is consistent with their meaning in the context of the relevant art and will not be interpreted in an ideal or excessively formal sense unless clearly defined as such in the present specification.

Like reference numerals refer to like elements throughout the specification.

Figure 2:
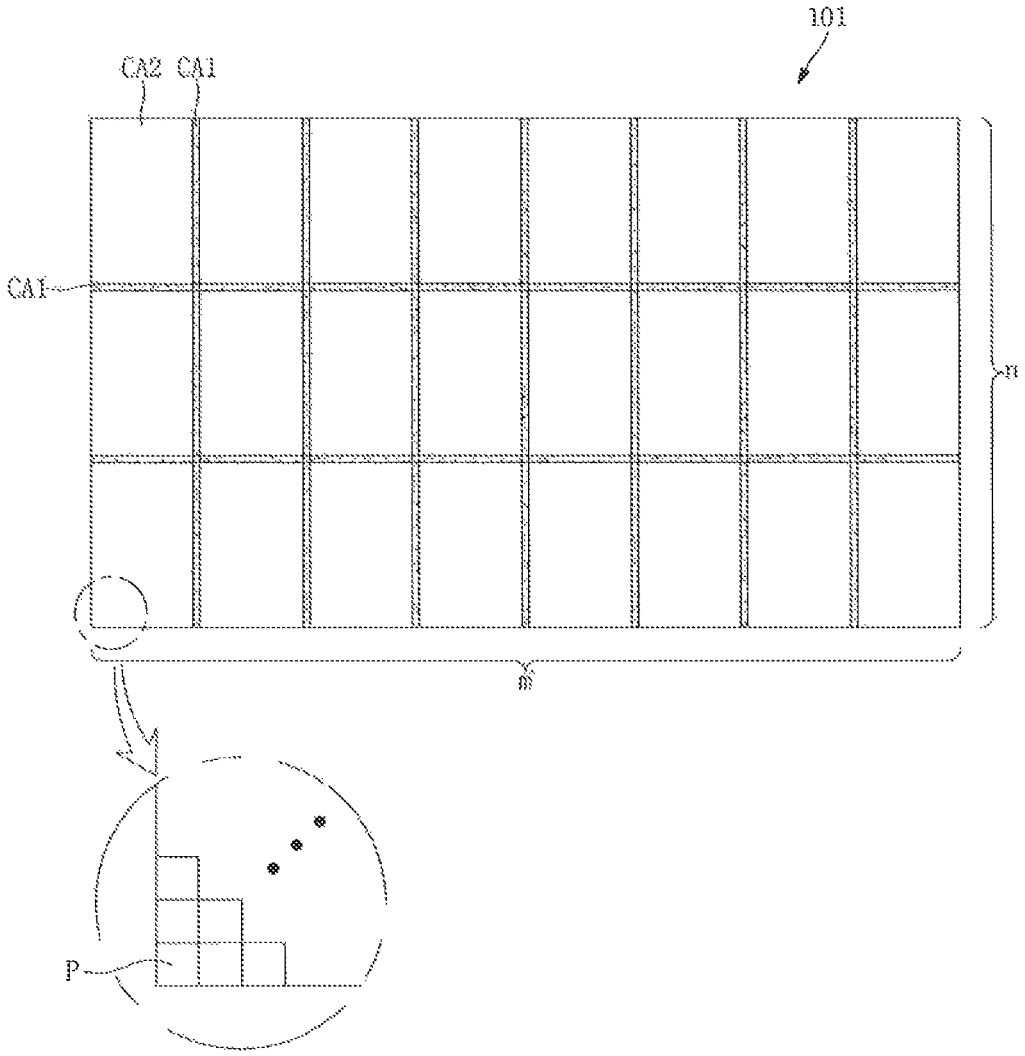
FIG. 2 is a plan view schematically illustrating a display area of the display device according to an embodiment of the inventive concept.

FIG. 1 is a block diagram illustrating a luminance compensation device of a display device according to an embodiment of the inventive concept, and FIG. 2 is a plan view schematically illustrating a display area of the display device according to an embodiment.

Referring to FIG. 1, a luminance compensation device 200 of a display device 100 includes a display driving circuit 210, an image acquisition assembly 220, a unit image generation circuit 230, a gamma curve generation circuit 240, a luminance compensation value calculation circuit 250 and a gray level compensation value calculation circuit 260.

The display device 100 may include a display panel or a panel module including a display panel and a light assembly. For example, the display device 100 according to an embodiment may include a light assembly having a mura and a display panel of a fair quality; a light assembly including a light source of a fair quality and a display panel having a mura; or a light assembly having a mura and a display panel having a mura. In addition, the display device 100 may be a flat panel display device or a curved panel display device.

Referring now to FIG. 2, the display device 100 includes a plurality of pixels P arranged in a matrix, and may have an M×N resolution, where M and N are natural numbers. In addition, a display area 101 of the display device 100 includes a first compensation area CA1 and a second compensation area CA2.

The first and second compensation areas CA1 and CA2 may be set by an operator. For example, the operator may set an area in which a fine line mura largely occurs as the first compensation area CA1 and may set an area other than the first compensation area CA1 as the second compensation area CA2.

For example, in a process of manufacturing the display device 100, an imprinting process using a stamp may be performed to form a wire grid polarization pattern over an entire surface of the display panel. For example, the wire grid polarization pattern may be formed over an entire surface of a large-sized display panel by repeatedly using a stamp having a planar area that may be less than a planar area of the display panel. In such an embodiment, misalignments may occur at a boundary between one stamp pattern and another stamp pattern adjacent to said one stamp pattern due to a change of the position of the stamp during the repeated use. Accordingly, a fine line mura may occur in the display area 101 of the display device 100. In such an embodiment, the operator may set an area in which the possibility of fine line mura occurrence is relatively high as the first compensation area CA1 in consideration of a planar area of the stamp, an alignment error range, and the like. For example, an area including a boundary between one stamp pattern and another adjacent stamp pattern is set as the first compensation area CA1, and a remaining area other than the first compensation area CA1 may be set as the second compensation area CA2.

As illustrated in FIG. 2, the display area 101 of the display device 100 may include the first compensation area CA1 in a lattice form and the second compensation area CA2 defined by the first compensation area CA1. However, the inventive concept is not limited to the arrangement shown in FIG. 1, and the first compensation area CA1 and the second compensation area CA2 may all be in the form of lines.

The display driving circuit 210 (FIG. 1) sequentially outputs to the display device 100*a* K number of reference gray level image data corresponding to the K number of reference gray levels wherein K is a natural number. Accordingly, the display device 100 receives the K number of reference gray level image data, and sequentially displays the K number of reference gray level images. The K number of reference gray levels may include, for example, ten sampled reference gray levels from gray level 0 to gray level 255. In such an embodiment of the inventive concept, the ten reference gray levels may include some of the following: gray level 0, gray level 16, gray level 24, gray level 32, gray level 64, gray level 96 and gray level 128, for example. However, the inventive concept is not limited thereto, and the K number of reference gray levels may be set variously.

The image acquisition assembly 220 acquires the K number of reference gray level images displayed on the display device 100. The image acquisition assembly 220 may be a charge coupled device (CCD) camera. Each reference gray level image is represented by M×N pixels, corresponding to the M×N resolution of the display device 100. Each pixel may include a plurality of sub-color pixels.

The unit image generation circuit 230 generates a reference unit image by reconstructing the reference gray level image with a reference pixel which is defined by at least one pixel. For example, the unit image generation circuit 230 may generate K number of reference unit images corresponding to the K number of reference gray level images, in such an embodiment, the reference pixel in the first compensation area CA1 is defined by one pixel, and the reference pixel in the second compensation area CA2 is defined by m×n pixels, wherein and n are natural numbers greater than 1. In other words, in the first compensation area CA1, the reference pixel is defined by 1×1 pixel, and in the second compensation area CA2, the reference pixel is defined by m×n pixels, which is larger than the reference pixel of the first compensation area CA1. In such an embodiment, m and n may be the same number or different numbers. Hereinafter, the reference pixel in the second compensation area CA2 according to an embodiment may be defined by 4×4 pixels by way of example, but embodiments of the inventive concept are not limited thereto.

In addition, the unit image generation circuit 230 determines a luminance representative value of the reference pixel included in each reference unit image. For example, a luminance representative value of the reference pixel in the first compensation area CA1 may be determined as a luminance value of one pixel, and a luminance representative value of the reference pixel in the second compensation area CA2 may be determined as an average luminance value, a maximum luminance value or a minimum luminance value of the m×n pixels constituting the reference pixel or a luminance value of a predetermined pixel among the m×n pixels. The unit image generation circuit 230 may determine the luminance representative values of the reference pixels corresponding to each of the K number of reference gray levels.

The gamma curve generation circuit 240 generates respective gamma curves of the reference pixels constituting the reference unit image. The gamma curve of each reference pixel is generated using the luminance representative values of said reference pixel. For example, when one reference pixel among the plurality of reference pixels is defined as a first reference pixel, a gamma curve of the first reference pixel is generated based on respective luminance representative values of the first reference pixels of the K number of reference unit images. Similarly, gamma curves of the remaining reference pixels constituting the reference unit image are generated. For example, in the case Where the display device 100 according to an embodiment includes X number of reference pixels, the gamma curve generation circuit 240 may generate X number of gamma curves corresponding to the X number of reference pixels, wherein X is a natural number.

The luminance compensation value calculation circuit 250 calculates a luminance compensation value of the reference pixel. For example, for each of the K number of reference unit images, target luminance values of the reference pixels are calculated using a two-dimensional fitting algorithm based on the luminance representative values of the reference pixels. The two-dimensional fitting algorithm may include, for example, polynomial fitting. Gaussian fitting, and the like. A person of ordinary skill in the art should understand and appreciate 2D fitting algorithms.

The luminance compensation value calculation circuit 250 calculates a difference between the luminance representative value and the target luminance value as the luminance compensation value of the reference pixel. The luminance compensation value calculation circuit 250 may calculate luminance compensation values of the reference pixels corresponding to each of the K number of reference gray levels.

The gray level compensation value calculation circuit 260 calculates a gray level compensation value corresponding to the luminance compensation value using the gamma curve of the reference pixel and outputs the gray level compensation value to a storage unit 110. The gray level compensation value calculation circuit 260 may calculate gray level compensation values of the reference pixels corresponding to each of the K number of reference gray levels.

The storage unit 110 stores the gray level compensation value of the reference pixel. The storage unit 110 may store the gray level compensation values of the reference pixels corresponding to each of the K number of reference gray levels. In such an embodiment, the storage unit 110 according to an embodiment is shown as a separate configuration, but the storage unit 110 is not limited thereto. The storage unit 110 may be embedded in the display device 100.

The display device 100 according to an embodiment sets one pixel as the reference pixel in the first compensation area CA1 and sets m×n pixels as the reference pixel in the second compensation area CA2, and the gray level compensation values are stored in units of the reference pixel. In such a manner, as the gray level compensation value is not stored for each pixel, the storage capacity of the storage unit may be reduced.

Figure 3:
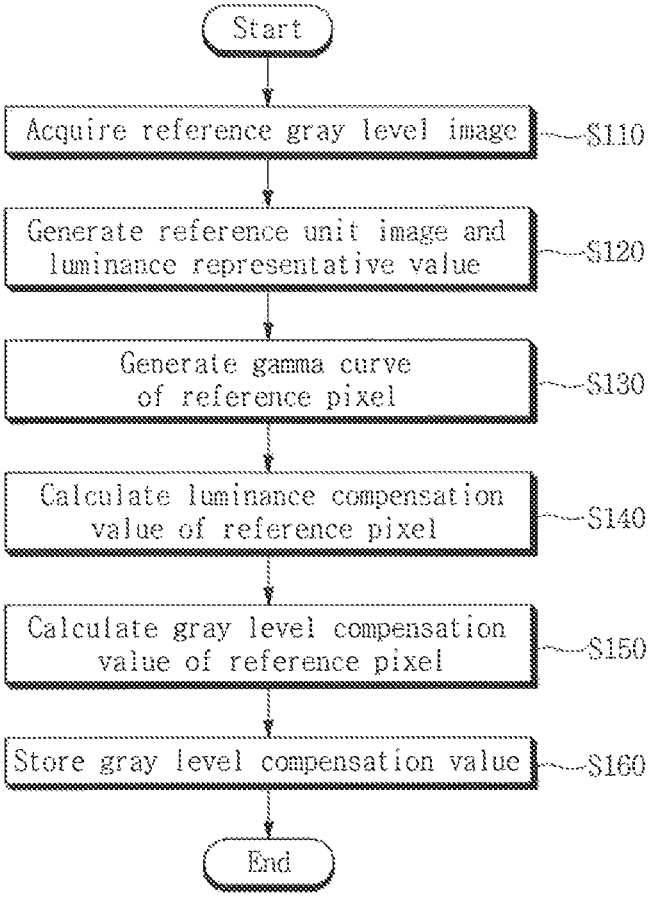
FIG. 3 is a flowchart illustrating a method of calculating a gray level compensation value by a luminance compensation device such as shown in FIG. 1.
Figure 4:
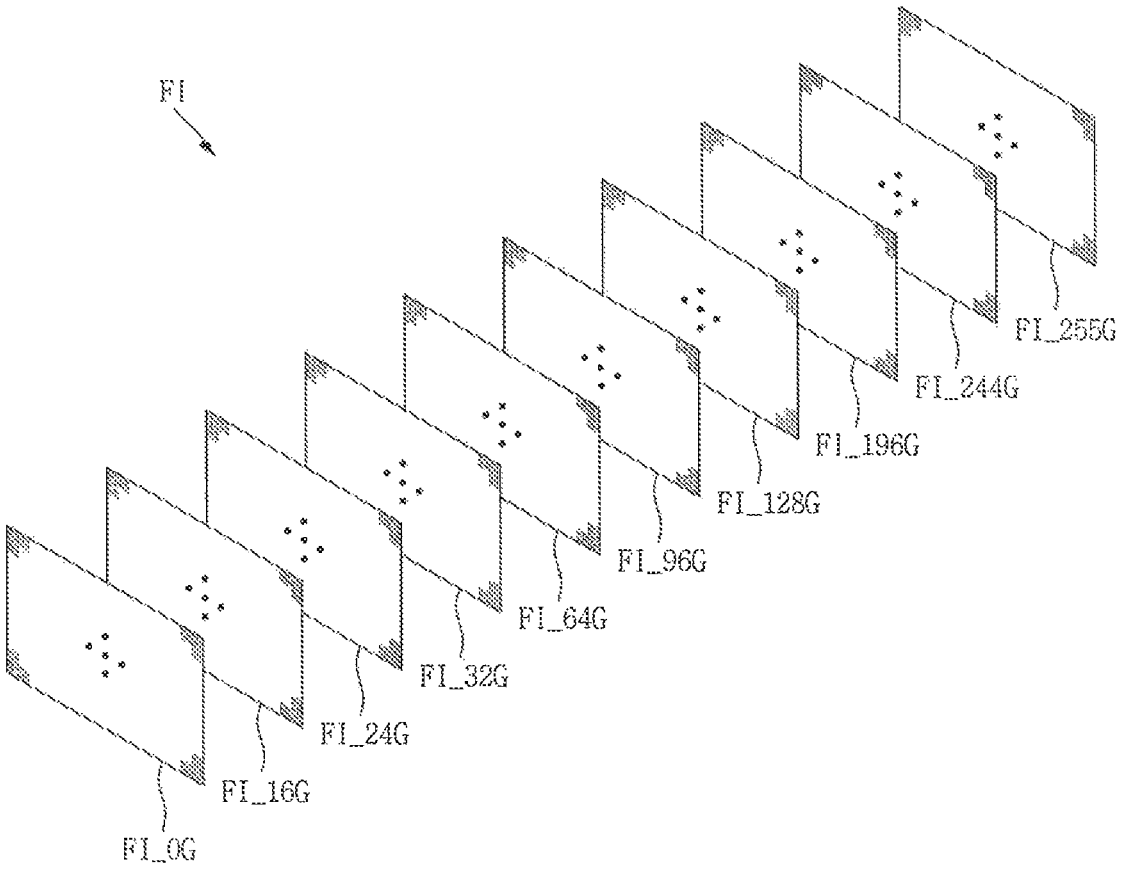
FIG. 4 is a conceptual diagram illustrating an image acquisition assembly of FIG. 1.
Figure 5:
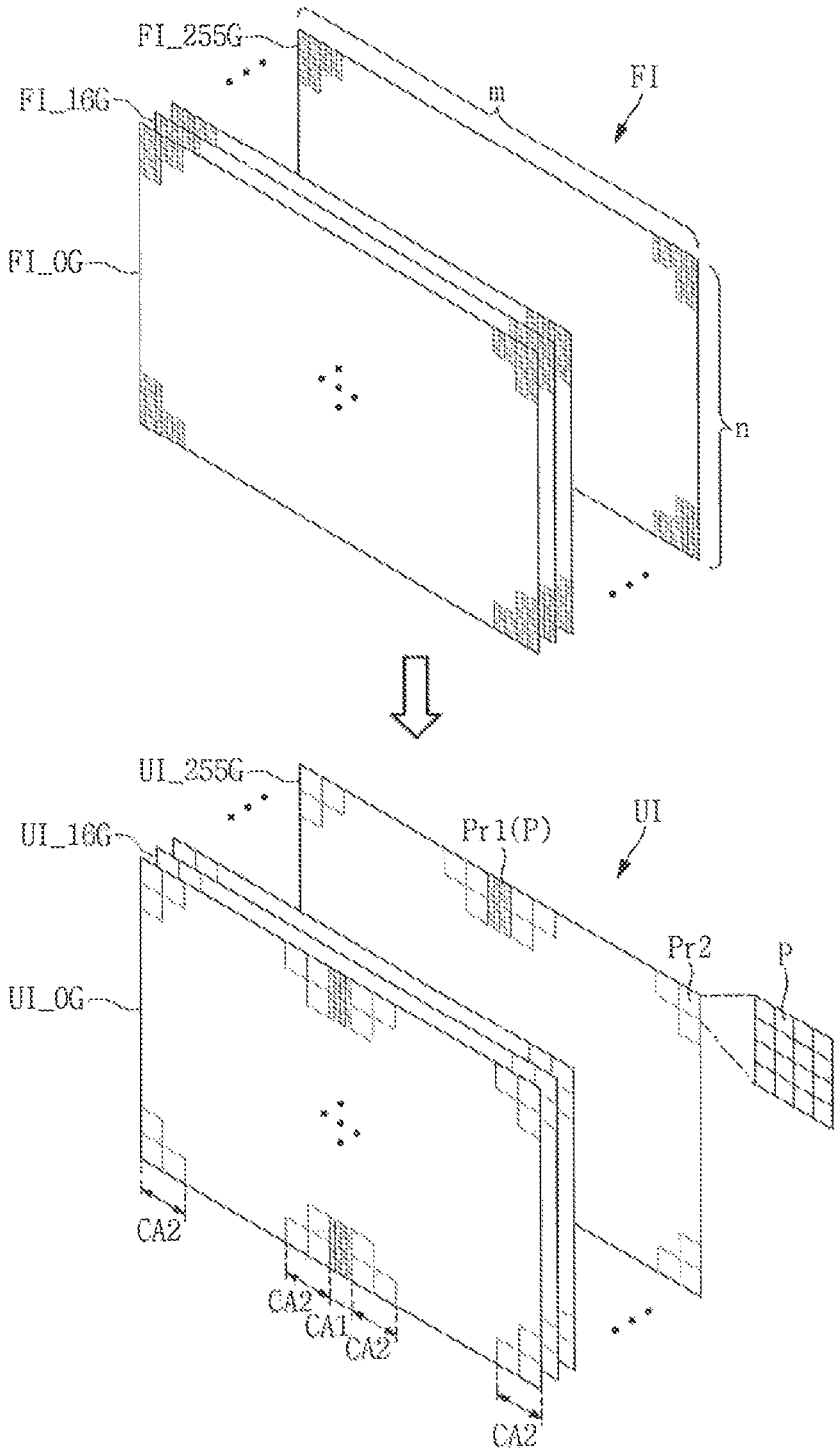
FIG. 5 is a conceptual diagram illustrating a unit image generation circuit of FIG. 1.
Figure 6:
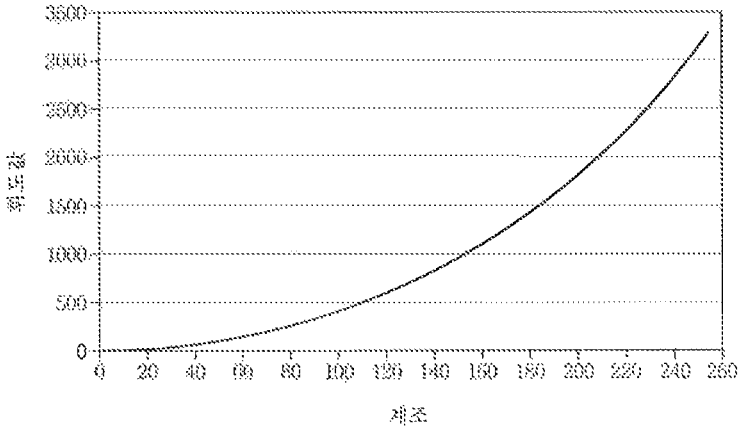
FIG. 6 is a conceptual diagram illustrating a gamma curve generation circuit of FIG. 1.

FIG. 3 is a flowchart illustrating a method of calculating a gray level compensation value by the luminance compensation device of FIG. 1, FIG. 4 is a conceptual diagram illustrating an image acquisition assembly of FIG. 1, FIG. 5 is a conceptual diagram illustrating a unit image generation assembly of FIG. 1, and FIG. 6 is a conceptual diagram illustrating a gamma curve generation circuit of FIG. 1.

Referring to FIGS. 1, 3 and 4, the image acquisition assembly 220 acquires ten reference gray level images FI_0G, FI_16G, FI_24G, FI_32G, FI_64G, FI_96G, FI_128G, FI_196G, FI_224G and FI_255G corresponding to ten reference gray levels displayed on the display device 100 (step S110).

Referring to FIGS. 1, 3 and 5, the unit image generation circuit 230 generates a reference unit image UI by reconstructing the reference gray level image F1 with respect to at least one pixel P. For example, the first compensation area CA1 of the display device 100 is reconstructed with respect to one pixel P, that is, 1×1 pixel P, as a reference pixel Pr1 and the second compensation area CA2 of the display device 100 is reconstructed with respect to 4×4 pixels P as a reference pixel Pr2, such that a reference unit image UI is formed. In such an embodiment, the unit image generation circuit 230 may generate ten reference unit images UI_255G corresponding to the ten reference gray level images FI_0G, FI_255G.

The unit image generation circuit 230 determines a luminance representative value of the reference pixels Pr1 and Pr2. The luminance representative value of the reference pixel Pr1 in the first compensation area CA1 is determined as a luminance value of said one pixel P and the luminance representative value of the reference pixel Pr2 in the second compensation area CA2 is determined as an average luminance value, a maximum luminance value or a minimum luminance value of said m×n pixels P constituting the reference pixel Pr2 or a luminance value of a predetermined pixel among said m n pixels P. The unit image generation circuit 230 may determine the luminance representative values of the reference pixels Pr1 and Pr2 corresponding to each of the ten reference gray levels 0G, 16G, and 255G (step S120).

Referring to FIGS. 1, 3 and 6, the gamma curve generation circuit 240 generates gamma curves of the reference pixels Pr1 and Pr2. For example, when one of the plurality of reference pixels Pr1 and Pr2 is defined as a first reference pixel Pr1, a gamma curve of the first reference pixel Pr1 is generated based on the luminance representative values of the ten first reference pixels Pr1 respectively included in the ten reference unit images UI_0G, . . . , UI_255G.

The gamma curve generation circuit 240 may generate gamma curves corresponding to the reference pixels Pr1 and Pr2 (step S130). For example, in the case where the display device 100 according to an embodiment includes X number of reference pixels Pr1 and Pr2, the gamma curve generation circuit 240 may generate X number of gamma curves corresponding to the X number of reference pixels Pr1 and Pr2. A gray level interval of the gamma curve may be variously set in units of 12 bits to 8 bits.

Referring to FIGS. 1 and 3, the luminance compensation value calculation circuit 250 calculates target luminance values using a two-dimensional fitting algorithm based on the X number of luminance representative values corresponding to each of the reference unit images UI_0G, . . . , UI_255G of the reference gray levels. The luminance compensation value calculation circuit 250 calculates difference values between the luminance representative values and the target luminance values, respectively, and determines the difference values as luminance compensation values of the reference pixels Pr1 and Pr2 (step S140).

Subsequently, the gray level compensation value calculation circuit 260 calculates gray level compensation values corresponding to the luminance compensation values of the reference pixels Pr1 and Pr2 by using the gamma curves of the reference pixels Pr1 and Pr2 generated in the gamma curve generation circuit 240 (step S150).

The gray level compensation values of the reference pixels Pr1 and Pr2 calculated in the gray level compensation value calculation circuit 260 are stored in the storage unit 110 (step S160). Accordingly, the gray level compensation values of the reference pixels Pr1 and Pr2 corresponding to each of the reference unit images UI_0G, . . . , UI_255G of the ten reference gray levels are stored in the storage unit 110.

The storage unit 110 may be embedded in a driving circuit of the display device 100. Accordingly, the display device 100 generates a compensated gray level datum by applying the gray level compensation value stored in the storage unit 110 to a received gray level datum, and the display device 100 displays an image using the compensated gray level datum. Through the above-described luminance compensation, the display device 100 according to an embodiment may have enhanced display quality.

Figure 7:
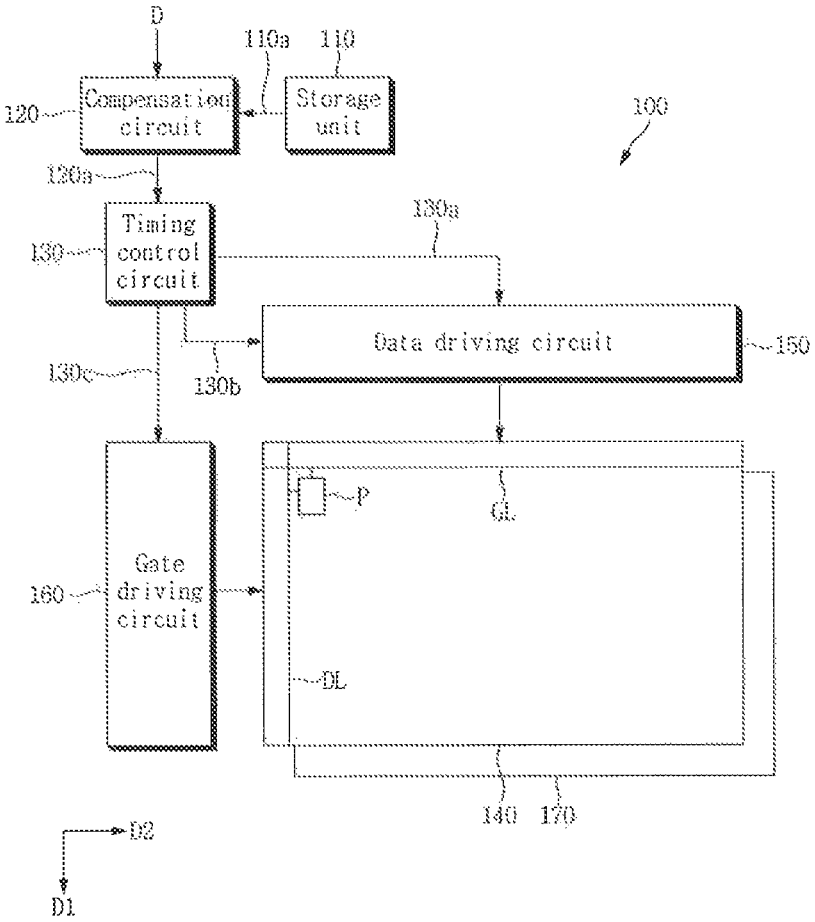
FIG. 7 is a block diagram illustrating a display device according to an exemplary embodiment of the inventive concept.

FIG. 7 is a block diagram illustrating a display device 100 according to an embodiment.

Referring to FIG. 7, the display device 100 includes the storage unit 110, a compensation circuit 120, a timing control circuit 130, a display panel 140, a data driving circuit 150, a gate driving circuit 160 and a light assembly 170.

The storage unit 110, as illustrated in FIGS. 1, 2, 3, 4, 5 and 6, stores the gray level compensation values for the reference pixels of each of the K number of reference unit images corresponding to the K number of reference gray levels.

The compensation circuit 120 generates a compensated gray level datum 120*a* by applying a gray level compensation value 110*a* stored in the storage unit 110 to a received gray level datum D. The luminance compensation method of the compensation circuit 120 will be described below in detail.

The timing control circuit 130 drives the data driving circuit 150 based on the compensated gray level datum 120*a* provided from the compensation circuit 120. For example, the timing control circuit 130 provides, to the data driving circuit 150, a compensated gray level datum 130*a* which is further compensated using a response speed compensation algorithm, a white compensation algorithm, and the like.

In addition, the timing control circuit 130 generates a data control signal 130*b* for controlling a driving timing of the data driving circuit 150 and a gate control signal 130*c* for controlling a driving timing of the gate driving circuit 150. The timing control circuit 130 controls the data driving circuit 150 based on the data control signal 130*b* and controls the gate driving circuit 160 based on the gate control signal 130*c*.

The display panel 140 includes a plurality of data lines DL, a plurality of gate lines GL, and a plurality of pixels P arranged in a matrix form. The data lines DL extend in a first direction D1 and are electrically connected to output terminals of the data driving circuit 150 to receive data voltages. The gate lines GL extend in a second direction D2 which crosses the first direction D1 and are electrically connected to output terminals of the gate driving circuit 160 to sequentially receive gate signals. Each of the pixels P may include a plurality of sub-color pixels.

The data driving circuit 150 converts the compensated gray level datum 130*a* into a data voltage by using a gamma voltage according to the control of the timing control circuit 130 and provides the data voltage to the data lines DL of the display panel 140.

The gate driving circuit 160 generates a gate signal according to the control of the timing control circuit 130 and provides the gate signal to the gate lines GL of the display panel 140.

The light assembly 170 includes at least one light source which generates light, and provides the light to the display panel 140. The light assembly 170 may have a direct-type structure and an edge-type structure.

Figure 8A:
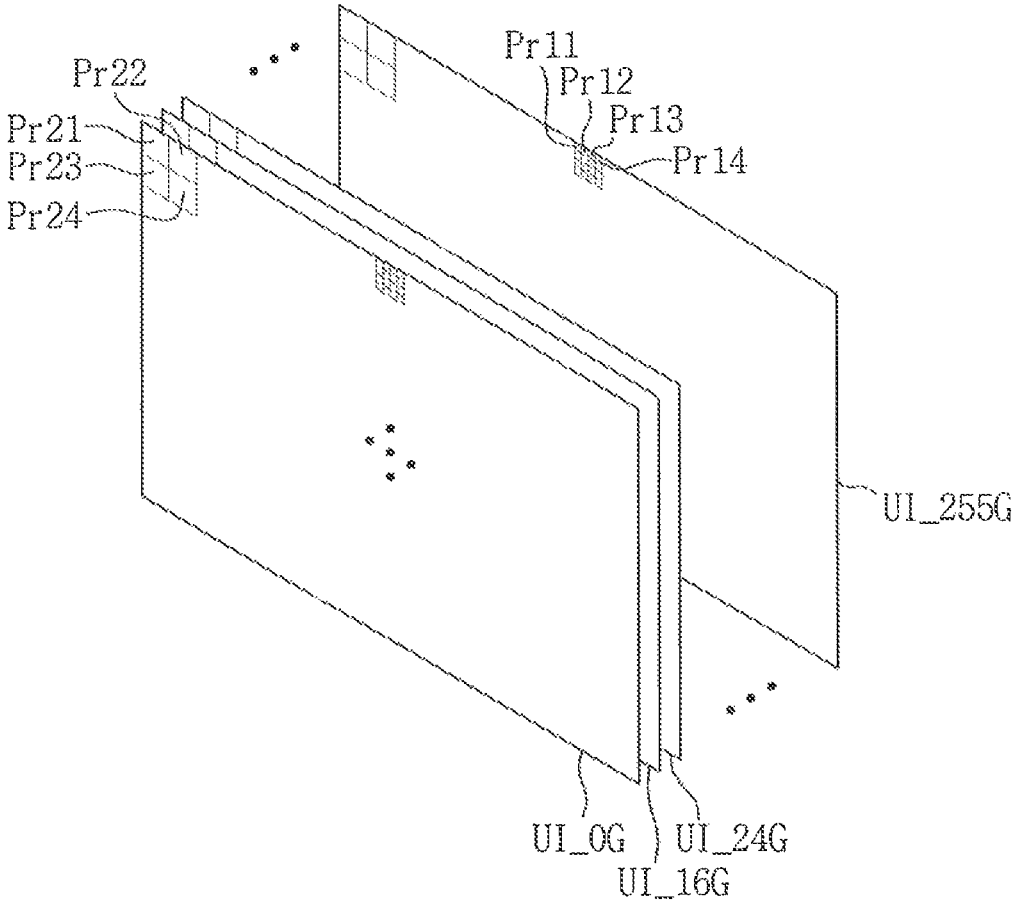
FIGS. 8A and 8B are conceptual diagrams illustrating a method of compensating a luminance of a display device such as shown in FIG. 7.
Figure 8B:
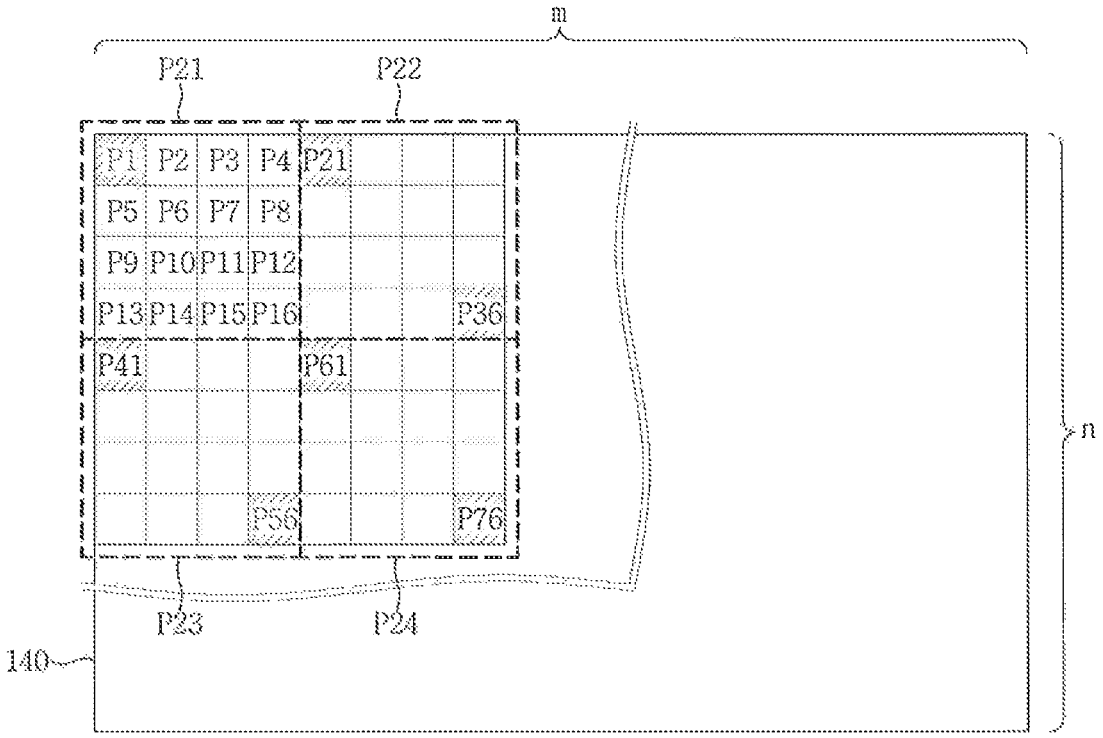

FIGS. 8A and 8B are conceptual diagrams illustrating a method of compensating a luminance of the display device of FIG. 7.

Referring to FIGS. 7, 8A and 8B, the storage unit 110 stores gray level compensation values of reference pixels Pr11, Pr12, Pr13, Pr14, Pr21, Pr22, Pr23 and Pr24 included in each of the reference unit images UI_0G, . . . , UI_255G of the ten reference gray levels. For example, as illustrated in FIG. 8A, the storage unit 110 stores gray level compensation values of the reference pixels Pr11, Pr12, Pr13, Pr14, Pr21, Pr22, Pr23 and Pr24 included in a reference unit image UI_0G of gray level "0," gray level compensation values of the reference pixels Pr11, Pr12, Pr13, Pr14, Pr21, Pr22, Pr23 and Pr24 included in a reference unit image UI_16G of gray level "16," gray level compensation values of the reference pixels Pr11, Pr12, Pr13, Pr14, Pr21, Pr22, Pr23 and Pr24 included in a reference unit image UI_24G of gray level "24," and gray level compensation values of the reference pixels Pr11, Pr12, Pr13, Pr14, Pr21, Pr22, Pr23 and Pr24 included in a reference unit image UI_255G of gray level "255."

The compensation circuit 120 receives a gray level datum corresponding to each of the M×N pixels of the display panel 140 and compensates the gray level datum by using the gray level compensation value stored in the storage unit 110.

For example, the pixels P in the first compensation area CA1 of the display panel are divided in units of one pixel, corresponding to the reference pixels Pr11, Pr12, Pr13 and Pr14 of each of the reference unit images UI_0G, . . . , UI_255G. In such an embodiment, the gray level compensation values of the reference pixels Pr11, Pr12, Pr13 and Pr14 in the first compensation area CA1 is a gray level compensation value of one pixel corresponding to each reference pixel.

In the case where a gray level datum of each of the pixels P respectively corresponding to the reference pixels Pr11, Pr12, Pr13 and Pr14 is equal to one of the ten reference gray levels stored in the storage unit 110, a gray level compensation value of said each pixel P is obtained from the storage unit 110.

For example, in the case where a gray level datum of one pixel P in the first compensation area CA1 is a 16-gray level datum stored in the storage unit 110, the compensation circuit 120 determines the gray level compensation value of one reference pixel (e.g., a pixel Pr11) corresponding to one pixel in a 16-gray level reference unit image UI_16G as the gray level compensation value of said one pixel P.

On the other hand, in the case where a gray level datum of each of the pixels P respectively corresponding to the reference pixels Pr11, Pr12, Pr13 and Pr14 differs from the ten reference gray levels stored in the storage unit 110, the gray level compensation value of said each pixel P is calculated and obtained using an interpolation method based on a gray level compensation value of at least one reference gray level close to the gray level datum of said each pixel P.

For example, in the case where a gray level datum of one pixel P in the first compensation area CA1 is a 10-gray level datum, the compensation circuit 120 obtains gray level compensation values of one reference pixel (e.g., a reference pixel Pr11) corresponding to one pixel from each of a 0-gray level reference unit image UI_0G and a 16-gray level reference unit image UI_16G which are close to gray level 10, and calculates a gray level compensation value corresponding to the 10-gray level datum by using an interpolation method based on the obtained gray level compensation values. The compensation circuit 120 determines the calculated gray level compensation value of the 10-gray level datum as the gray level compensation value of said one pixel P.

The pixels P of the display panel 140 in the second compensation area CA2 may be divided in units of 4×4 pixels, corresponding to the reference pixels Pr21, Pr22, Pr23 and Pr24 of each of the reference unit images UI_0G, . . . , UI_255G. For example, as illustrated in FIG. 8. When reference pixels in the second compensation area CA2 are defined as first, second, third and fourth reference pixels Pr21, Pr22, Pr23 and Pr24, first to sixteenth pixels P1 to P16 may correspond to the first reference pixel Pr21, twenty-first to thirty-sixth pixels P21 to P36 may correspond to the second reference pixel Pr22, forty-first to fifth-sixth pixels P41 to P56 may correspond to the third reference pixel Pr23, and sixty-first to seventh-sixth pixels P61 to P76 may correspond to the fourth reference pixel Pr24.

In such an embodiment, a gray level compensation value of the first reference pixel Pr21 may be a gray level compensation value of the first pixel P1 which is a predetermined one of the first to sixteenth pixels P1 to P16, a gray level compensation value of the second reference pixel Pr22 may be a gray level compensation value of the twenty-first pixel P21 which is a predetermined one of the twenty-first to thirty-sixth pixels P21 to P36, a gray level compensation value of the third reference pixel Pr23 may be a gray level compensation value of the fourth-first pixel 41 which is a predetermined one of the forty-first to fifth-sixth pixels P41 to P56, and a gray level compensation value of the fourth reference pixel Pr24 may be a gray level compensation value of the sixty-first pixel 61 which is a predetermined one of the sixty-first to seventh-sixth pixels P61 to P76.

The compensation circuit 120 obtains a gray level compensation value of a predetermined pixel among 4×4 pixels of a reference pixel and/or a gray level compensation value of a predetermined pixel among 4×4 pixels of at least one adjacent reference pixel close to said reference pixel.

First, in the case where a gray level datum of the first pixel P1 corresponding to the first reference pixel Pr21 is equal to one of the ten reference gray levels stored in the storage unit 110, a gray level compensation value of the first pixel P1 is obtained from the storage unit 110.

For example, in the case where the gray level datum of the first pixel P1 is a 16-gray level datum stored in the storage unit 110, the compensation circuit 120 determines the gray level compensation value of the first reference pixel Pr21 in the 16-gray level reference unit image UI_16G as the gray level compensation value of the first pixel P1.

Similarly, in the case where each of gray level data of the twenty-first, forty-first and sixty-first pixels P21 P41 and P61, which are predetermined pixels corresponding to the second, third and fourth reference pixels Pr22, Pr23 and Pr24, is equal to one of the ten reference gray levels stored in the storage unit 110, respective gray level compensation values of the twenty-first, forty-first and sixty-first pixels 121, P41 and P61 are obtained from the storage unit 110.

For example, in the case where a gray level datum of the twenty-first pixel P21 is a 36-gray level datum stored in the storage unit 110, the compensation circuit 120 determines the gray level compensation value of the second reference pixel Pr22 in the 36-gray level reference unit image UI_36G as the gray level compensation value of the twenty-first pixel 121.

In addition, in the case where a gray level datum of the forty-first pixel P41 is a 24-gray level datum stored in the storage unit 110, the compensation circuit 120 determines the gray level compensation value of the third reference pixel Pr23 in the 24-gray level reference unit image UI_24G as the gray level compensation value of the forty-first pixel P41.

In addition, in the case where a gray level datum of the sixty-first pixel P61 is a 64-gray level datum stored in the storage unit 110, the compensation circuit 120 determines the gray level compensation value of the fourth reference pixel Pr24 in the 64-gray level reference unit image UI_24G as the gray level compensation value of the sixty-first pixel P61.

On the other hand, in the case where the gray level datum of the first pixel P1 corresponding to the first reference pixel Pr11 is different from the ten reference gray levels stored in the storage unit 110, the gray level compensation value of the first pixel P1 is calculated and obtained using an interpolation method based on a gray level compensation value of at least one reference gray level close to the gray level datum of the first pixel P1.

For example, in the case where the gray level datum of the first pixel P1 is a 10-gray level datum, the compensation circuit 120 obtains, from the storage unit 110, gray level compensation values of the first reference pixel Pr1 from the 0-gray level reference unit image UI_0G and the 16-gray level reference unit image UI_16G which are close to gray level 10, and calculates a gray level compensation value corresponding to the 10-gray level datum using an interpolation method based on the obtained gray level compensation values. The compensation circuit 120 determines the calculated gray level compensation value of the 10-gray level datum as the gray level compensation value of the first pixel P1.

Similarly, in the case where each of the gray level data of the twenty-first, forty-first and sixty-first pixels P21, P41 and P61, which are predetermined pixels corresponding to the second, third and fourth reference pixels Pr22, Pr23 and Pr24, is different from one of the ten reference gray levels stored in the storage unit 110, respective gray level compensation values of the twenty-first, forty-first and sixty-first pixels P21, P41 and P61 are calculated and obtained using an interpolation method based on the gray level compensation values stored in the storage unit 110.

For example, in the case where the gray level datum of the twenty-first pixel p21 of the second reference pixel Pr2 is a 20-gray level datum, the compensation circuit 120 obtains, from the storage unit 110, a gray level compensation value of the second reference pixel Pr22 from the 16-gray level reference unit image UI_16G and the 24-gray level reference unit image UI_24G which are close to gray level 20, and calculates a gray level compensation value corresponding to the 20-gray level datum using an interpolation method based on the obtained gray level compensation values. The compensation circuit 120 determines the calculated gray level compensation value of the 20-gray level datum as the gray level compensation value of the twenty-first pixel P21.

In addition, in the case where the gray level datum of the forty-first pixel p41 is a 23-gray level datum, the compensation circuit 120 obtains, from the storage unit 110, a gray level compensation value of the third reference pixel Pr23 from the 16-gray level reference unit image UI_16G and the 24-gray level reference unit image UI_24G which are close to gray level 23, and calculates a gray level compensation value corresponding to the 23-gray level datum using an interpolation method based on the obtained gray level compensation values. The compensation circuit 120 determines the calculated gray level compensation value of the 23-gray level datum as the gray level compensation value of the forty-first pixel p41.

In addition, in the case where the gray level datum of the sixty-first pixel p61 is a 30-gray level datum, the compensation circuit 120 obtains, from the storage unit 110, a gray level compensation value of the fourth reference pixel Pr24 from the 24-gray level reference unit image UI_24G and the 36-gray level reference unit image UI_36G which are close to gray level 30, and calculates a gray level compensation value corresponding to the 30-gray level datum using an interpolation method based on the obtained gray level compensation values. The compensation circuit 120 determines the calculated gray level compensation value of the 30-gray level datum as the gray level compensation value of the sixty-first pixel p61.

When the gray level compensation values corresponding to the gray level data of the first pixel P1 of the first reference pixel Pr21 and the twenty-first, forty-first and sixty-first pixels P21, P41 and P61 of the second, third and fourth reference pixels Pr22, Pr23 and Pr24 are obtained in the manner described above, gray level compensation values of the other pixels P2 to P16 of the first reference pixel Pr21 may be calculated using an inter-grayscale linear interpolation method and an inter-pixel spatial interpolation method based on the gray level compensation values of the first, twenty-first, forty-first and sixty-first pixels P1, P21, P41 and P61.

The compensation circuit 120 according to an embodiment calculates the gray level compensation values corresponding to the entirety of the pixels P and generates a compensated gray level datum by applying the gray level compensation value corresponding to the received gray level datum.

The data driving circuit 150 drives the pixels P of the display panel 140 based on the compensated gray level data provided from the compensation circuit 120.

According to an embodiment, the first compensation area CA1, which is highly likely to cause fine line mura, performs luminance compensation on a pixel-by-pixel basis to enhance the display quality of the display device, and the second compensation area CA2, which has a relatively low probability of fine line mura occurrence, performs luminance compensation in units of a reference pixel which is defined by m×n pixels P, thereby reducing the storage capacity of the storage unit.

Hereinafter, an alternative embodiment of the present inventive concept will be described with reference to FIG. 9. The descriptions of the configurations substantially identical to those of an embodiment will be omitted for convenience of explanation.

Figure 9:
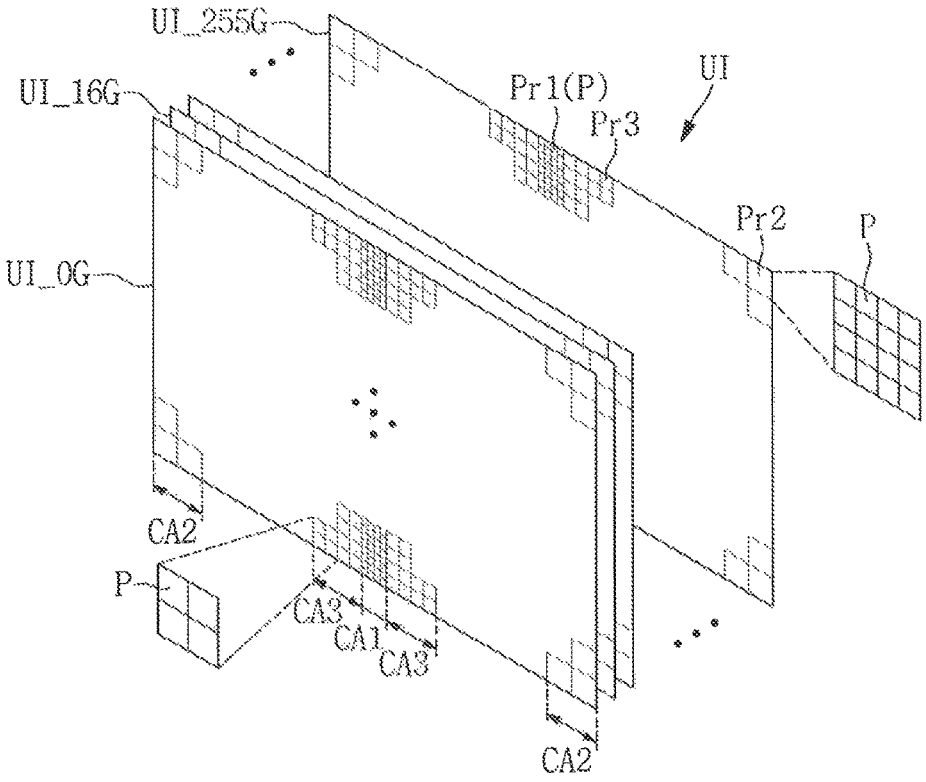
FIG. 9 is a conceptual diagram illustrating a display device according to an embodiment of the inventive concept.

FIG. 9 is a conceptual diagram illustrating a display device according to an alternative embodiment.

Referring to FIG. 9, the display device according to an alternative embodiment further includes a third compensation area CA3 between a first compensation area CA1 and a second compensation area CA2.

The first, second and third compensation areas CA1, CA2, and CA3 may be set by an operator. For example, the operator may set an area with a relatively high probability of fine line mura occurrence as the first compensation area CA1, an area with a relatively low probability of fine line mura occurrence as the second compensation area CA2, and an area between the first compensation area CA1 and the second compensation area CA2 as the third compensation area CA3.

In such an embodiment, a reference pixel in the first compensation area CA1 is defined by one pixel, a reference pixel in the second compensation area CA2 is defined by m×n pixels, m and n each being a natural number greater than 1, and a reference pixel in the third compensation area CA3 is defined by i×j pixels, i and j each being a natural number greater than 1. In such an embodiment, i and j each are numbers less than m and n.

In other words, the reference pixel in the first compensation area CA1 is defined by 1×1 pixel, the reference pixel in the second compensation area CA2 is defined by m×n pixels which is larger than the reference pixel of the first compensation area CA1, and the reference pixel in the third compensation area CA3 is defined by i×j pixels which is larger than the reference pixel of the first compensation area CA1 and less than the reference pixel of the second compensation area CA2, where m may be the same number as n, and i may be the same number as j.

For example, as illustrated in FIG. 9, the reference pixel in the first compensation area CA1 may be defined by 1×1 pixel, the reference pixel in the second compensation area CA2 may be defined by 4×4 pixels, and the reference pixel in the third compensation area CA3 may be defined by 2×2 pixels. However, embodiments of the inventive concept are not limited thereto.

The display device according to an alternative embodiment includes the first, second and third compensation areas CA1, CA2, and CA3, and sets reference pixels of the first, second and third compensation areas CA1, CA2, and CA3 differently, thereby capable of enhancing the display quality.

As set forth hereinabove, according to one or more embodiments, the display quality of a display device may be enhanced and the storage capacity of a memory may be reduced by including first and second compensation areas in the display device and differently setting reference pixels of the first and second compensation areas.

While the present inventive concept has been illustrated and described with reference to the embodiments thereof, it will be apparent to those of ordinary skill in the art that various changes in form and detail may be formed thereto without departing from the spirit and scope of the present inventive concept.

What is claimed is:

1. A display device comprising:

a display panel comprising a plurality of pixels arranged in a matrix form, and a first compensation area and a second compensation area;

a storage unit configured to store a gray level compensation value of a reference pixel defined by at least one pixel;

a compensation circuit that receives a gray level datum and generates a compensated gray level datum by applying the gray level compensation value; and a data driving circuit receiving the compensated gray level datum to generate a data voltage and outputting the data voltage to the display panel, wherein the reference pixel in the first compensation area is defined by one pixel and the reference pixel in the second compensation area is defined by m×n pixels, m and n being natural numbers greater than 1.

2. The display device according to claim 1, wherein the first compensation area is formed in a lattice arrangement, and the second compensation area is defined by the lattice arrangement of the first compensation area.

3. The display device according to claim 1, wherein the first compensation area includes a boundary between at least two stamp patterns that are aligned to form a wire grid polarization pattern on a surface of the display panel, wherein the boundary has an increased probability of an occurrence of fine line mura based on an alignment error range of the at least two stamp patterns.

4. The display device of claim 1, wherein the gray level compensation value of the reference pixel in the first compensation area comprises a gray level compensation value of the one pixel and the gray level compensation value of the reference pixel in the second compensation area comprises a gray level compensation value of a predetermined pixel of the m×n pixels.

5. The display device of claim 1, wherein the storage unit stores a gray level compensation value for the reference pixel corresponding to each one of a plurality of reference gray levels.

6. The display device of claim 1, wherein in the second compensation area defined by the m×n pixels, m is a number equal to n.

7. The display device of claim 1, further comprising a third compensation area arranged between the first compensation area and the second compensation area.

8. The display device of claim 7, wherein a reference pixel in the third compensation area is defined by i×j pixels, i and j being natural numbers greater than 1.

9. The display device of claim 8, wherein each of i and j is a number less than m and n.

10. The display device of claim 1, further comprising a light assembly including at least one light source providing a light to the display panel.

11. A method of compensating a luminance, the method comprising:

acquiring, by an image acquisition assembly, a reference gray level image displayed on a display device including a first compensation area and a second compensation area on a surface of a display panel and a plurality of pixels arranged in a matrix form;

generating, by a unit image generation circuit, a reference unit image by reconstructing the reference gray level image with a reference pixel;

calculating, by a gray level compensation value calculation circuit, a gray level compensation value of the reference pixel comprised in the reference unit image; and generating compensated gray level data by applying the gray level compensation value of the reference pixel to gray level data corresponding to the plurality of pixels, wherein the reference pixel of the first compensation area is defined by one pixel and the reference pixel of the second compensation area is defined by m×n pixels, m and n being natural numbers greater than 1.

12. The method of claim 11, wherein the calculating of the gray level compensation value of the reference pixel comprises:

determining a luminance representative value of the reference pixel comprised in the reference unit image;

generating, by a gamma curve generation circuit, a gamma curve of the reference pixel;

calculating, by a luminance compensation value calculation circuit, a luminance compensation value of the reference pixel by using the luminance representative value of the reference pixel; and calculating the gray level compensation value of the reference pixel corresponding to the luminance compensation value by using the gamma curve of the reference pixel.

13. The method of claim 12, wherein determining of the luminance representative value of the reference pixel comprises determining a luminance value of the one pixel as the luminance representative value of the reference pixel in the first compensation area.

14. The method of claim 12, wherein the determining of the luminance representative value of the reference pixel includes determining an average luminance value, a maximum luminance value or a minimum luminance value of the m×n pixels constituting the reference pixel or a luminance value of a predetermined pixel among the m×n pixels as the luminance representative value of the reference pixel in the second compensation area.

15. The method of claim 12, wherein the calculating of the luminance compensation value of the reference pixel comprises:

calculating a target luminance value of the reference pixel using a two-dimensional fitting algorithm based on the luminance representative value of the reference pixel; and determining a difference value between the luminance representative value of the reference pixel and the target luminance value of the reference pixel as the luminance compensation value of the reference pixel.

16. The method of claim 15, wherein the two-dimensional fitting algorithm comprises at least one of polynomial fitting or Gaussian fitting.

17. The method of claim 11, further comprising storing, in a storage unit, the gray level compensation value of the reference pixel comprised in the reference unit image.

18. The method of claim 11, wherein in the m×n pixels that define the second compensation area, m is a number equal to n.

19. The method of claim 11, wherein the surface of the display panel includes a plurality of stamp patterns that form a wire grid polarization pattern, and the first compensation area includes a boundary between at least two of the plurality of stamp patterns that form the wire grid polarization pattern.

20. A display device that provides luminance compensation, comprising:

a display panel including a first compensation area and a second compensation area, in which the first compensation area is predefined to a first portion of a surface of the display panel in which an occurrence of fine line mura has a higher probability to occur than on another portion of the display panel designated as a second compensation area, and a reference pixel in the first compensation area is defined by one pixel and a reference pixel in the second compensation area is defined by m×n pixels, m and n being natural numbers greater than 1; and wherein the reference pixel of the first compensation area is defined by one pixel and the reference pixel of the second compensation area is defined by m×n pixels being natural numbers.

* * * * *